United States Patent [19]

Gonzalez

[11] Patent Number: 4,850,539

[45] Date of Patent: Jul. 25, 1989

[54] SHOWERHEAD APPARATUS

[75] Inventor: Teodoro J. Gonzalez, Canyon Country, Calif.

[73] Assignee: Price Pfister, Inc., Pacoima, Calif.

[21] Appl. No.: 435

[22] Filed: Jan. 5, 1987

[51] Int. Cl.[4] ..... B05B 15/08; B05B 1/18

[52] U.S. Cl. ..... 239/558; 239/587

[58] Field of Search ..... 239/600, 581, 460, 558, 239/DIG. 4, 428.5, 556; 4/612

[56] References Cited

U.S. PATENT DOCUMENTS

| | | | |
|---|---|---|---|
| 2,086,017 | 7/1937 | Donahue | 239/587 |
| 2,661,473 | 11/1953 | Hansen | 239/587 |
| 3,081,040 | 3/1963 | Hartman | 239/600 |
| 3,145,932 | 8/1964 | Mango | 239/587 |
| 3,254,842 | 6/1966 | Bachli et al. | 239/460 |
| 3,380,664 | 4/1968 | Miller et al. | 239/600 |
| 3,384,307 | 3/1968 | Moen | 239/460 |
| 3,623,670 | 11/1971 | Wakeman | 230/587 |
| 3,887,136 | 6/1975 | Anderson | 239/587 |
| 4,484,711 | 11/1984 | Constantinescu et al. | 239/460 |

*Primary Examiner*—Andres Kashnikow
*Assistant Examiner*—Kevin P. Weldon
*Attorney, Agent, or Firm*—Barry E. Deutsch

[57] ABSTRACT

In an improved showerhead a bulb portion having a channel for receipt of water therethrough, there is provided and a threaded collar for removeably coupling the bulb portion to a water supply source together with a housing comprising an outer housing portion and an inner housing portion in threadable relationship with one another and having a first O-ring disposed circumferentially about the bulb portion and proximate to the bulb portion channel. The inner housing portion has a front plate portion having a second O-ring disposed peripherally thereabout and between the same and said outer housing portion such that the second O-ring exerts a friction against rotational movement between the front plate portion and the outer housing portion, which is greater than the friction exerted by said first O-ring.

9 Claims, 1 Drawing Sheet

SHOWERHEAD APPARATUS

BACKGROUND OF THE INVENTION

1. Field of the Invention

The present invention relates to showerheads, and more particularly to an improved showerhead.

2. Art Background

Over the years, due to the rising manufacturing costs and the rising costs of water and materials, a need has developed for a showerhead which may be manufactured at a substantially low cost, which may be disassembled for cleaning and replacement of component parts, increasing the life of the showerhead, and which also provides an optimum efficiency in the dispersion of water.

In the past, prior art showerheads have been made from many different parts which are usually formed from metallic material. The most common disadvantage of such prior art showerheads is that material costs are quite high. Further, such prior art showerheads are not easily disassembled for cleaning or for replacement of the component parts and typically require the use of tools for installation.

Recently, some prior art showerheads have been developed which attempt to overcome the problems of high material costs due to the use of many metallic parts. These prior art showerheads are formed from plastic material and are manufactured at a relatively low cost, however, they are typically not capable of being disassembled. This creates a critical problem in that particles present in the water system are retained within the interior of such showerheads and, eventually, clog the passages that produce the water spray thereby causing poor performance of the showerhead. Also, an attendant problem of the inability to disassemble is that replacement of expendable component parts is impossible.

Additionally, the efficiency of such prior art showerheads is such that the flow rate of the water outputted is often quite high, thereby resulting in, over the lifetime of the showerhead, literally thousands of gallons of wasted water.

Recently, certain legislatures have inacted regulations for conserving water which sets maximum limits on the flow rate of showerheads. For example, in the state of California, the California Energy Commission requires that showerheads have a maximum flow rate of 3 gallons per minute ("gpm") at 20 to 80 psi. At a flow rate of 3 gpm, the spray pattern of prior art showerheads typically degrade considerably such that the total effectiveness of the spray is drastically decreased.

SUMMARY OF THE INVENTION

Accordingly, it is an object of the present invention to provide a showerhead which may be manufactured and sold at a low cost.

It is a further object of the present invention to provide a showerhead which has a minimal number of parts and which may be easily disassembled, without the use of tools, for cleaning and for replacement of component parts.

It is still a further object of the present invention to provide a showerhead which may be installed without the use of tools.

It is still a further object of the present invention to provide a showerhead which provides an effective spray pattern at low flow rates (i.e. 3 gpm) so that the total efficiency of the showerhead spray is maintained at such low flow rates.

The above objects are achieved in an improved showerhead apparatus comprising a bulb portion having a channel for receipt of water therethrough, the bulb portion also having attachment means for removeably coupling the bulb portion to a water supply source; an outer housing portion having a circumferential flange portion being in abutting contact wih an inner portion of the bulb portion thereby permitting radial pivoting of the outer housing portion about the bulb portion; the housing also having an inner housing portion in threadable relationship with the outer housing portion, the inner housing portion having a friction means disposed circumferentially about the bulb portion and proximate to the bulb portion channel such that the inner housing portion abuts against the friction means thereby creating friction against rotational movement of the inner housing portion and the bulb portion; the inner housing portion having a front plate portion disposed at the forward end of the showerhead, the front plate portion having a plurality of apertures for the outputting of water therethrough; the plate portion having a second friction means disposed peripherally thereabout and between the same and the outer housing portion such that the second friction means exerts a friction against rotational movement between the plate portion and the outer housing portion, the second friction means exerting a greater friction than the first friction means; wherein the showerhead may be radially pivoted about the bulb portion by applying a first force and wherein the inner housing portion may be unthreaded and thereby decoupled from the outer housing portion by the application of a second force which is greater than the first force.

DETAILED DESCRIPTION OF THE INVENTION

Figure 1:
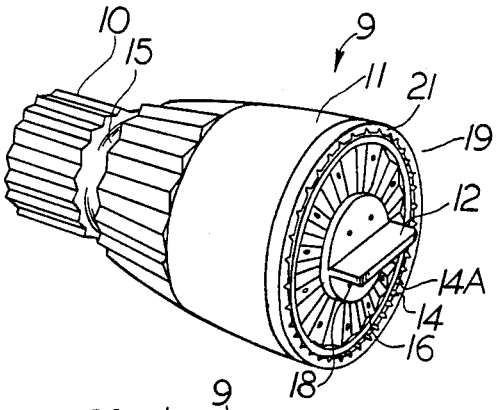
FIG. 1 shows a perspective view of the invented showerhead apparatus.

In FIG. 1 there is shown a perspective view of an improved showerhead apparatus embodying the concepts of the present invention, and being generally denoted by reference numeral 9. The showerhead 9 has a front plate 19 at the forward end of the showerhead 9 having a plurality of holes disposed circumferentially and concentrically around and within the front plate 19. The showerhead 9 also has a substantially unitary housing 11 having a lip portion 21 which is provided with a plurality of "U" shaped channels 14A which abut a front platelip 20 of the front plate 19 so as to form a first outer periphery of circumferentially aligned holes 14. Holes 14 are equadistantly spaced apart from one another in order to provide a substantially uniform outer column of water spray. Disposed on the inner region of plate 19 are a second plurality of circumferentially aligned holes 16 which are also equadistantly spaced apart from one another so as to provide a uniform central column of water spray. Disposed in the center of front plate 19 is a position adjustment knob 12 which provides a gripping means for adjusting the swivel pressure or disassembly of the showerhead as will later be described. Position adjustment knob 12 has disposed thereon a third plurality of inner circumferentially aligned holes 18.

Together, in operation, outer holes 14, central holes 16, and inner holes 18 collectively provide a uniform and constant spray pattern of water. In order to maximize the quality of the spray pattern provided by the showerhead 9 under low flow rates (i.e. at 3 gpm or less between the range 20 to 80 psi) it has been discovered that the preferred number of holes is between 50 to 55 when the collective cross-sectional area of the holes is within the range of 0.2 to 0.25 square inches such that the average area size is equivalent to a hole diameter of approximately 0.037 inches. Accordingly, in the preferred embodiment, holes 14, 16 and 18 collectively amount to 52 holes each having an area size equivalent to a diameter of approximately 0.037 inches, at a flow rate of 3 gpm, the collective force of all the jets is approximately one half pound and will generate a spray column 6 feet high. It will therefore be appreciated that the invented showerhead 9 provides a high quality spray pattern at an optimum force yet at low flow rates thereby providing a spray of maximum efficiency.

The housing 11 of showerhead 9 is disposed over a bulb 15 (shown in FIG. 2) for rotational movement thereabout. The bulb 15 ends in a collar portion 10 which serves the purpose of providing a means for attaching the showerhead 9 to a water supply source.

Figure 2:
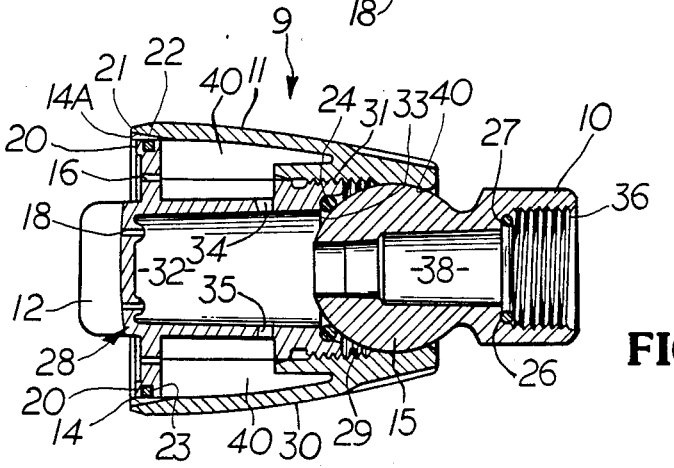
FIG. 2 shows a cross-sectional view of the showerhead apparatus shown in FIG. 1.
Figure 3:
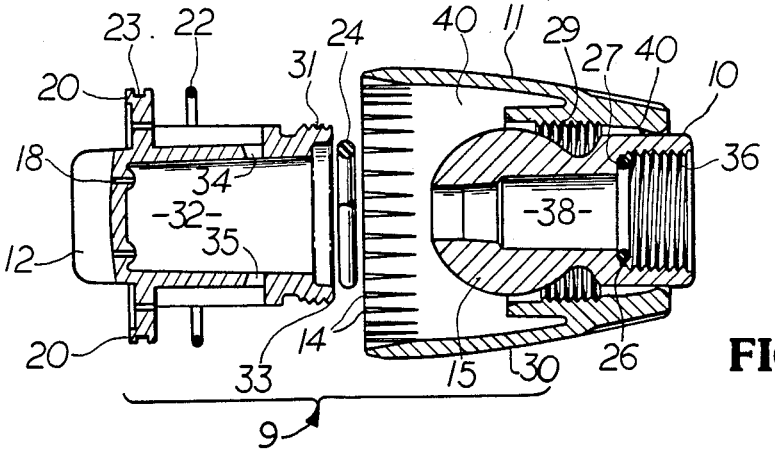
FIG. 3 shows a partially exploded cross-sectional view of the showerhead apparatus shown in FIG. 2.

FIG. 2 shows a cross-sectional view of the showerhead 9 shown in FIG. 1. Description of the interior components of the showerhead 9 will also be made with reference to FIG. 3 wherein there is shown a cross-sectional partially exploded view of the showerhead apparatus 9. The housing 11 is comprised of an inner housing portion 28 and an outer housing portion 30. The outer housing portion 30 has a threaded outer bore portion 29 adopted to threadedly receive a threaded inner bore portion 31 of the inner housing portion 28. As stated, inner threaded bore portion 31 of inner housing portion 28 is, when the showerhead 9 is assembled, threadably engaged with the outer threaded bore portion 29 of the outer housing portion 30. Inner housing portion 28 also has an O-ring seat portion 33 within which is disposed an inner O-ring 24 which, when assembled, is in abutting contact with the outer region of the bulb 15, as shown in FIG. 2.

The outer housing portion 30 also has a circular flange portion 40, which, during assembly is forced over the central portion of the bulb 15 until circular flange portion 40 slips over the central portion of the bulb 15 and comes to rest at the inner region of the bulb 15 near collar portion 10, as shown in FIG. 2.

It will be appreciated that circular flange portion 40, inner housing portion 28 (and O-ring 24 thereof) together with bulb 15 collectively provide a pivot means for the showerhead 9 such that the housing 11 maybe radially pivoted about bulb portion 15.

Disposed at the forward end of inner housing portion 28 along the peripheral edge of front plate 19 is an outer O-ring channel 23 having an outer O-ring 22 which, when the showerhead 9 is assembled, is in abutting relationship with outer housing portion 30 and inner housing portion 28. Since the outer O-ring 22 has a larger diameter than inner O-ring 24, the former exerts a greater friction than the later. In the preferred embodiment, the friction ratio between the outer O-ring 22 and the inner O-ring 24 is approximately 2 to 1. Accordingly, when a user attempts to pivot the showerhead housing 11 radially about the bulb 15 by grasping and turning position knob 12, because during such turning a greater degree of friction is present at the outer O-ring 22 than is present at inner O-ring 24, the outer housing portion 30 and the inner housing portion 28 turn together such that inner housing portion 28 will not become inadvertantly unthreaded from outer housing portion 30. However, when it is desired to remove inner housing portion 28 from outer housing portion 30 for purposes of cleaning and/or replacement of the interior component parts of the showerhead 9, a user merely grips the outer housing portion 30 and turns the position knob 12 in a direction and with a force necessary to unthread the inner threaded bore portion 31 from the outer threaded bore portion 29. Thus, it will be appreciated that disassembly of the showerhead apparatus 9 is accomplished in a simple and easy manner and without the use of tools.

Bulb 15 is provided with a bulb water channel 38 which is in fluid communication with, when installed, a water supply source. In operation, water outflows from bulb water channel 38 into central water chamber 32. Central water chamber 32 is defined by inner housing portion 28. Provided at locations proximate to the output port of the bulb water channel 38 are a pair of circumferential vents 34 and 35. Vents 34 and 35 are in fluid communication with a circular outer water chamber 40. In operation, water flowing through bulb water channel 38 fills central water chamber 32 such that water is then forced through vents 34 and 35 into the outer water chamber 40. Additionally, central water chamber 32 serves the purpose of acting as a muffler in quieting the noise caused by the jet of water outflowing from bulb water channel 38. As such, the invented showerhead 9 is very quiet during operation. Jets of water are produced at the front plate of the showerhead through holes 14, 16 and 18, as previously discussed with reference to FIG. 1.

In most prior art showerheads that are typically comprised metallic material the threaded collar portion which attaches to the water supply source is typically a tapered thread (i.e. wherein the threaded bore portion of the collar tapers from a larger diameter to a narrower diameter as the bore approaches the interior of the showerhead). Such tapered threading necessitates the use of tools in the installation of the prior art showerhead since the sealing between the showerhead and the water supply source depends entirely upon a friction mating between the threads of the outlet pipe of the water supply source and the threads of the taper threaded bore of the prior art showerhead. As such, a wrench is required in order to apply a force great enough to friction mate the threads together. In the present invention, the threaded bore 36 of the collar 10 is a straight thread and does not taper. The sealing engagement with the outlet pipe of the water supply source is accomplished, in the present invention, by means of a collar O-ring 26 which rests against collar O-ring seat 27 sealing of the collar 10 to an outlet pipe of water supply source and thus, is not, accomplished by means of a friction mating with the threads of the bore 36 and the threads of the water supply source outlet pipe. As such, the force required to thread the collar 10 onto a threaded pipe of a water supply source is much less than that required in the above discussed taper threaded prior art showerheads. Accordingly, the showerhead 9 may be installed entirely by hand without the use of tools. Collar O-ring 26 is, in the preferred embodiment, made of rubber however, it may be formed from any other elastomeric material which has similar characteristics and a resilience sufficient to maintain a proper seal between the outlet port of a water source and the threaded bore portion 36 of the collar 10.

In the preferred embodiment, the inner housing portion 28, the outer housing portion 30, and the bulb 15 are comprised of substantially resilient plastic material so that material costs are thereby minimized. It will be appreciated, however, that the showerhead 9 may also be constructed of metallic material such as brass or stainless steel.

It will therefore also be appreciated that an efficient showerhead which is easily disassembled for cleaning and replacement of component parts yet which will not inadvertently loosen during operation and which provides an optimum spray pattern that does not degrade at low flow rates and which also may be installed and disassembled without the use of tools, is provided.

It will also be appreciated that the above-described invention maybe embodied in other specific forms without departing from the essential characterics thereof. The present embodiment is to be considered, therefore, in all aspects as illustrative and unrestrictive, the scope of the invention being indicated by the appended claims rather than by the foregoing description and all changes which come within the meaning and range of equivalency are, therefore, intended to be embraced therein.

What is claimed is:

1. An improved showerhead apparatus comprising:

a bulb portion having, a channel for receipt of water therethrough and an attachment means for removeably coupling said bulb portion to a water supply source;

a housing, said housing comprising:

an outer housing portion having a circumferential flange portion being in abutting contact with an inner portion of said bulb portion thereby permitting radial pivoting of said outer housing portion about said bulb portion;

said housing also having an inner housing portion in threadable relationship with said outer housing portion, said inner housing portion having a first friction means disposed circumferentially about said bulb portion and proximate to said bulb portion channel such that said inner housing portion abuts against said first friction means thereby exerting a first friction against rotational movement of said inner housing portion and said bulb portion;

said inner housing portion having a front plate portion disposed at the forward end of said showerhead, said front plate portion having a plurality of apertures for the outputting of water therethrough;

said front plate portion having a second friction means disposed peripherally thereabout and between the same and said outer housing portion such that said second friction means exerts a friction against rotational movement between said front plate portion and said outer housing portion which is greater than said first friction;

wherein said showerhead may be radially pivoted about said bulb portion by applying a first force and wherein said inner housing portion may be unthreaded from said outer housing portion by applying a second force which is greater than said first force.

2. The apparatus according to claim 1 wherein said inner housing portion forms a central chamber, said chamber being in fluid communication with said bulb portion channel for receipt of water flowing therefrom and wherein the outer surface of said chamber and the inner surface of said outer housing portion forms a peripheral chamber extending circumferentially around said central chamber, said central chamber and said peripheral chamber being in fluid communication with one another such that water flowing through said bulb portion channel into said central chamber outflows into said peripheral chamber and such that noise caused by the water outflowing from said bulb portion channel is muffled by said central chamber.

3. The apparatus according to claim 1 wherein said plurality of holes have, an accumulative cross-sectional area within 0.2 to 0.25 square inches.

4. The apparatus according to claim 1 wherein said first friction means comprises a first O-ring and said second friction means comprises a second O-ring.

5. An improved showerhead apparatus comprising:

a first portion having a channel for receipt of water therethrough said first portion also having attachment means for removeably coupling said first portion to a water supply source;

a housing, said housing comprising:

an outer housing portion and an inner housing portion, said inner housing portion being in threadable relationship with said outer housing portion, said inner housing portion having a first friction means disposed circumferentially about said first portion and proximate to said first portion channel such that said inner housing portion abuts against said first friction means thereby exerting a first friction against rotational movement of said inner housing portion and said first portion;

a front plate portion disposed at the forward end of said showerhead, having a plurality of apertures for the outputting of water therethrough;

said front plate portion having a second friction means disposed peripherally thereabout and between the same and said outer housing portion such that said second friction means exerts a friction against rotational movement between said plate portion and said outer housing portion, which is greater than said first friction;

wherein said showerhead may be radially pivoted about said first portion by applying a first force and wherein said inner housing portion may be unthreaded from said outer housing portion by applying a second force which is greater than said first force.

6. The apparatus according to claim 5 wherein said inner housing portion forms a central chamber, said chamber being in fluid communication with said first portion channel for receipt of water flowing therefrom and wherein the outer surface of said chamber and the inner surface of said outer housing portion forms a peripheral chamber extending circumferentially around said central chamber, said central chamber and said peripheral chamber being in fluid communication with one another such that water flowing through said first portion channel into said central chamber outflows into said peripheral chamber and such that noise caused by the water outflowing from said first portion channel is muffled by said central chamber, said central chamber and said peripheral chamber being in fluid communication with said plurality of holes.

7. The apparatus according to claim 5 wherein said plurality of holes have, an accumulative cross-sectional area within the range of 0.2 inches to 0.25 square inches.

8. The apparatus according to claim 7 wherein said plurality of holes are within the range of 50 to 55 in number such that each hole has an average area size equivalent to a hole diameter of substantially 0.037 inches.

9. An improved showerhead apparatus comprising:

a bulb portion having a channel for receipt of water therethrough and an attachment means for removeably coupling said bulb portion to a water supply source;

a housing, said housing comprising:

an outerhousing portion, said housing also having an inner housing portion in threadable relationship with said outer housing portion, said inner housing portion having a first O-ring for exerting a first friction disposed circumferentially about said bulb portion and proximate to said bulb portion channel;

said inner housing portion having a front plate portion having a tab for positioning said showerhead and a second O-ring disposed peripherally thereabout and between the same and said outer housing portion a predetermined distance away from said bulb portion such that said second friction means exerts a second friction between said plate portion and said outer housing portion, said second friction being greater than said first friction thereby preventing inadvertent disengagement of said inner housing from said outer housing when said tab is gripped and said showerhead is positioned.

* * * * *